US012123162B2

(12) United States Patent
Nakamoto et al.

(10) Patent No.: US 12,123,162 B2
(45) Date of Patent: Oct. 22, 2024

(54) SYSTEM, METHOD, AND APPARATUS FOR ACCURATELY DETERMINING PAYLOAD TRANSFER

(71) Applicant: Caterpillar SARL, Geneva (CH)

(72) Inventors: Yozo Nakamoto, Akashi (JP); Michio Aoki, Akashi (JP); Keisuke Shirani, Akashi (JP); Koichi Murata, Akashi (JP); Kensuke Tanaka, Akashi (JP)

(73) Assignee: Caterpillar SARL, Geneva (CH)

( * ) Notice: Subject to any disclaimer, the term of this patent is extended or adjusted under 35 U.S.C. 154(b) by 463 days.

(21) Appl. No.: 17/488,298

(22) Filed: Sep. 29, 2021

(65) Prior Publication Data

US 2023/0095687 A1 Mar. 30, 2023

(51) Int. Cl.

| | |
|---|---|
| ***E02F 3/00*** | (2006.01) |
| ***E02F 3/43*** | (2006.01) |
| ***E02F 9/00*** | (2006.01) |
| ***E02F 9/20*** | (2006.01) |
| ***E02F 9/26*** | (2006.01) |

(52) U.S. Cl.

CPC ..... *E02F 3/432* (2013.01); *E02F 9/2029* (2013.01); *E02F 9/265* (2013.01)

(58) Field of Classification Search

CPC ..... E02F 3/432; E02F 9/2029; E02F 9/265; E02F 9/26

See application file for complete search history.

(56) References Cited

U.S. PATENT DOCUMENTS

| | | | | |
|---|---|---|---|---|
| 6,931,772 | B2 | 8/2005 | Furuno et al. | |
| 2018/0066415 | A1* | 3/2018 | Friend | E02F 9/262 |
| 2020/0033183 | A1* | 1/2020 | Tomita | E02F 9/264 |
| 2022/0099533 | A1* | 3/2022 | Rajasekharan | G01M 99/005 |
| 2022/0343524 | A1* | 10/2022 | Kyu | G06T 7/521 |

FOREIGN PATENT DOCUMENTS

| | | | |
|---|---|---|---|
| JP | 2001-91345 | A | 4/2001 |
| JP | 2002-285589 | A | 10/2002 |
| JP | 2012-36645 | A | 2/2012 |
| JP | 2021021246 | A | 2/2021 |
| WO | 03/033829 | A1 | 4/2003 |

OTHER PUBLICATIONS

Written Opinion and International Search Report for Int'l. Patent Appln. No. PCT/EP2022/0254428, mailed Feb. 7, 2023 (118 pgs).

* cited by examiner

*Primary Examiner* — Yonel Beaulieu

(57) ABSTRACT

Systems, methods, and apparatuses can accurately determine proper payload transfer from a working implement of a working machine. Such systems, methods, and apparatuses can identify occurrence of a payload discharge event for the working implement; determine whether a position of the working implement at a time of the identification of the occurrence of the payload discharge event is in a preset working area or a preset discharge area; omit the payload discharge event from registration for a tally of discharge material payload amount under a first case where the position of the working implement is determined to be in the working area; and register the payload discharge event for the tally under a second case where the position of the work implement is determined to be in the discharge area. The tally of the discharge material payload amount may be increased by a load amount associated with the load discharge event.

20 Claims, 10 Drawing Sheets

SYSTEM, METHOD, AND APPARATUS FOR ACCURATELY DETERMINING PAYLOAD TRANSFER

TECHNICAL FIELD

The present disclosure relates to accurately determining or identifying proper payload transfer from a working implement of a working machine.

BACKGROUND

Japanese Patent Document JP2001-91345 ("the JP '345 Publication") describes a work amount monitoring apparatus for a hydraulic excavator capable of automatically and accurately measuring the load of a transported object during loading work. More specifically, the JP '345 Publication describes a load computing means which computes a load inside a bucket during a swiveling operation used to scoop up and transport the object to be transported and which computes a load inside a bucket during a swiveling operation after the object to be transported is discharged is installed. The JP '345 Publication also describes bucket-dumping-operation detection means which output a load measuring command when the load difference between the loads during the two swiveling operations is at a prescribed value or higher and when a bucket dumping operation is executed in a range of a prescribed angle in a swiveling direction are installed. And the JP '345 Publication further describes a load measuring means by which a load immediately before the bucket dumping operation is measured as the load of the object, to be transported, when the load measuring command is output is installed.

However, application of methodologies for handling payload (e.g., load capacity, load calculation, load measurement, etc.) in hydraulic excavators with conventional buckets having associated therewith a rotational sensor (e.g., an anisotropic magneto-resistive (AMR) sensor) to sense when the bucket articulates to dump its payload may not be applicable to excavators with working implements in the form of either grapples or clamshells or without such rotational sensor to sense when the bucket articulates to dump its payload. For instance, miscounts may occur in a case where the operator performs a re-grab of the material in the event that the material falls from the working implement before reaching the desired dump or discharge point or area. That is, conventional systems may count a drop and re-grab of material as two deposits of different material, even though the same material is eventually discharged to the initially intended position.

SUMMARY

According to aspects of one or more embodiments of the disclosed subject matter, a non-transitory computer-readable storage medium having stored thereon instructions that, when executed by one or more processors, causes the one or more processors to perform a method is disclosed or implemented. The method can comprise: identifying occurrence of a payload discharge event for a working implement of a working machine; determining whether a position of the working implement at a time of the identification of the occurrence of the payload discharge event is in a preset working area or a preset discharge area; omitting the payload discharge event from registration for a tally of discharge material payload amount under a first case where the position of the working implement is determined to be in the working area at the time of the identification of the occurrence of the payload discharge event; and registering the payload discharge event for the tally of discharge material payload amount under a second case where the position of the work implement is determined to be in the discharge area at the time of the identification of the occurrence of the payload discharge event, the tally of the discharge material payload amount being increased by a load amount associated with the load discharge event.

In other aspects of one or more embodiments of the disclosed subject matter, a method for accurately determining proper payload transfer from a working machine having a grapple or a clamshell as a working implement is disclosed or implemented. The method can comprise: setting, using a controller, a working area and a discharge area around the working machine responsive to an input to an operator interface of the working machine; identifying, using the controller, occurrence of a load discharge event for the working implement based on a load on the grapple decreasing by at least a predetermined value; detecting, using a position sensor of the working machine, a position of the working implement at a time of said identifying the occurrence of the load discharge event; determining, using the controller, whether the detected position of the working implement at the time of the identification of the occurrence of the load discharge event is in the working area or the discharge area; maintaining, using the controller, a total discharge material payload amount in a first case where the detected position is determined to be in the working area at the time of the identification of the occurrence of the load discharge event; and increasing and saving in memory, using the controller, the total discharge material payload amount in a second case where the detected position is determined to be in the discharge area at the time of the identification of the occurrence of the load discharge event, the total discharge material payload amount being increased by a load amount of the load discharge event.

And in other aspects of one or more embodiments of the disclosed subject matter, a working machine can be disclosed or provided. The working machine can comprise: a chassis; an operator station supported by the chassis, the operator station including an operator interface and a manual control device to control the working machine; a working implement, in the form of a grapple, supported by the chassis, the working implement and the operator station being rotatable about an axis in an overhead plan view of the working machine, and the grapple being radially extendable and retractable to and from outermost and innermost positions, respectively; and a controller. The controller can be configured to control movement of the working implement responsive to operator input using the manual control device, determine a position of the grapple relative to predetermined working and dumping areas for the working machine defined by at least one preset boundary between the working area and the dumping area, identify a candidate dumping event for the grapple based on a decrease in a load on the grapple, determine whether the determined position of the grapple is in the working area or the dumping area responsive to the identification of the candidate dumping event, characterize the candidate dumping event as an invalid dumping event and maintain a dump material payload count in a first case where the determined position of the grapple is in the working area upon the identification of the candidate dumping event, and characterize the candidate dumping event as a valid dumping event and increase the dump material payload count in a second case where the determined position of the grapple is in the dumping area upon the identification of the candidate dumping event.

Other features and aspects of this disclosure will be apparent from the following description and the accompanying drawings.

DETAILED DESCRIPTION

Embodiments of the disclosed subject matter can involve accurately determining or identifying proper payload transfer from a working implement of a working machine. Additionally or alternatively, embodiments of the disclosed subject matter can involve accurately determining or identifying improper payload transfer from the working implement.

Figure 1:
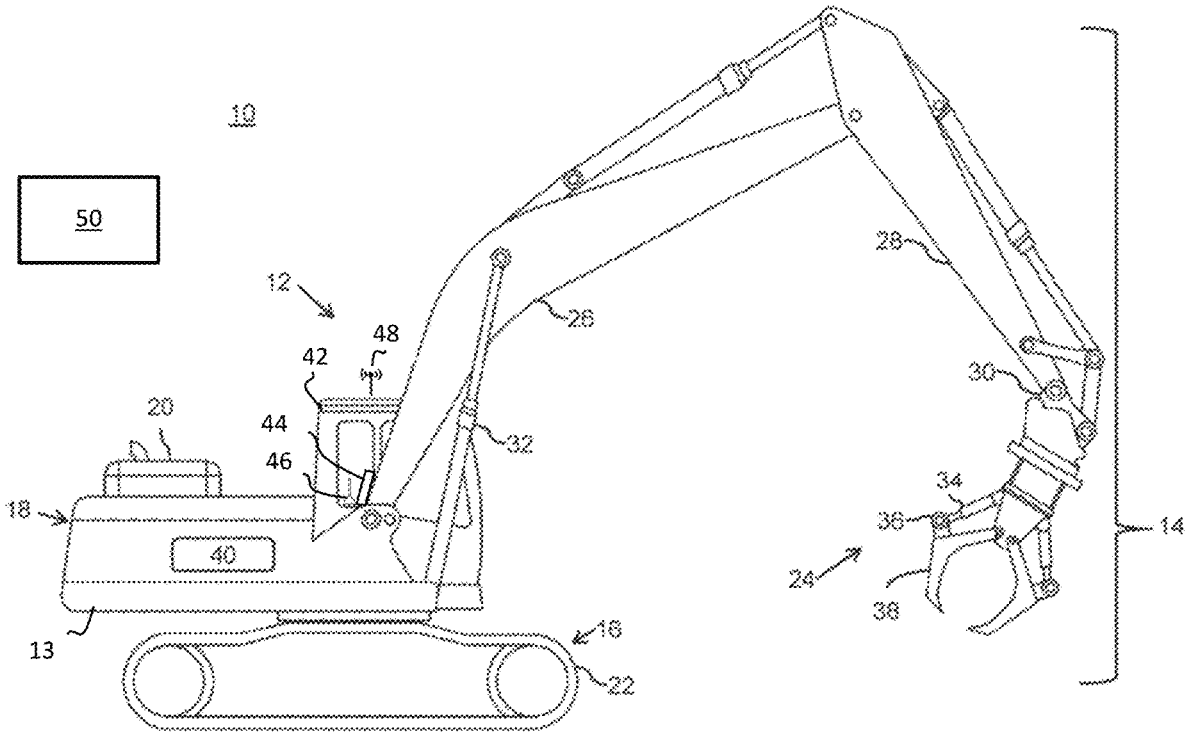
FIG. 1 is a diagram of a system according to one or more embodiments of the disclosed subject matter.

FIG. 1 is a diagram of a system 10 according to one or more embodiments of the disclosed subject matter. The system 10 can include a working or work machine 12 and optionally a back office system 50.

The working machine 12, which may be a forest grapple, can be mobile or non-mobile. In one embodiment, the working machine 12 may include, but is not limited to, machines (e.g., vehicles) that perform some type of operation associated with a particular industry, such as mining, construction, farming, transportation, forestry, etc. and operate between or within work environments, e.g., construction sites, mine sites, forests, power plants, on-highway applications, marine applications, demolition applications (e.g., grabbing and dumping or demolishing vehicles), etc.

The working machine 12 can include a frame or chassis 13, a working implement system 14, a drive system 16, and a power system 18 that provides power to the working implement system 14 and the drive system 16. The working machine 12 can also include a control system 40.

The power system 18 can include an engine 20, for example, an internal combustion engine. In alternative embodiments the power system 18 may include additional or other power sources, such as electric motors, fuel cells, batteries, ultra-capacitors, electric generators, etc.

The drive system 16 may include a transmission and ground propelling devices (in a case where the working machine 12 is mobile). The transmission may include any device or group of devices that can transfer force between the power system 18 and the ground propelling devices. The transmission may include one or more of a mechanical transmission, gearing, belts, pulleys, discs, chains, pumps, motors, clutches, brakes, torque converters, fluid couplings, etc. According to one or more embodiments, the propelling device can include tracks 22. In alternative embodiments the propelling devices may additionally or alternatively include wheels.

Optionally, an operator station 42 may be provided on or otherwise supported by the chassis 13. An operator interface 44 and a manual control device 46 to control the working machine 12 can be provided in the operator station 42. The operator interface 44 and the manual control device 46 can be operatively coupled to the control system 40. Optionally, one or both of the operator interface 44 and the manual control device 46 may be considered part of the control system 40.

The operator interface 44 may be a control panel, for instance, implemented on or as a display device operative to display, for instance, a graphical user interface (GUI) providing some or all of the operator interface 44. Such operator interface 44, according to embodiments of the disclosed subject matter, may be implemented using multiple display devices. A non-limiting example of the manual control device 46 is or includes one or more joysticks, though embodiments of the disclosed subject matter are not so limited. Alternatively, the operator station 42 (and thus the operator interface 44 and the manual control device 46) may be provided offboard the working machine 12, for instance, at the back office system 50.

The manual control device 46 can control rotation of the chassis 13, the operator station 42, and the working implement system 14, for instance, relative to the drive system 16. Discussed in more detail below, such rotation may be about an axis in an overhead plan view of the working machine 12. Moreover, such rotation may be referred to or characterized as swing, particularly, swing of the working implement system 14.

The manual control device 46 may also control movement of the working implement system 14 relative to the chassis 13 (and the drive system 16). For instance, the manual control device 46 may be operated to move the working implement system 14 to an outermost or most extended position, i.e., as far away from the chassis 13 and/or operator station 42 as possible. Likewise, the manual control device 46 can be operated to move the working implement system 14 to an innermost or least extended position, i.e., as close to the chassis 13 and/or the operator station 42 as limitations allow. Such movement of the working implement system 14 may be characterized as or considered to be in a radial direction. Thus, the working implement system 14 can be radially extendable and retractable to and from outermost and innermost positions, respectively.

The working implement system 14 can include a working implement 24, which may perform work at a worksite. The working implement system 14 may include any members and linkages, as well as any systems and controls to actuate the members and linkages as a function of operator, autonomous system, or other inputs, to maneuver the working implement 24 to perform work at the worksite. In one or more embodiments, the working implement system 14 can include or otherwise be operatively coupled to a boom 26, a stick 28, a connector coupling 30, at least one boom cylinder assembly 32, a hydraulic cylinder pair assembly 34, a linkage pair 36, and a pair of grapple tongs 38 pivotable at respective pivoting points. The working implement system 14, thus, can be supported by the chassis 13 either directly or indirectly (if the boom 26, stick 28, etc. are not considered part of the working implement system 14).

The working implement 24 may be or include a clamshell or a grapple, such as shown in FIG. 1. In the case of the grapple or the clamshell as the working implement 24, optionally, the working implement system 14 may be without a position sensor to sense opening of the grapple tongs 38 (or shells) to dump or discharge its payload. Alternatively, according to embodiments of the disclosed subject matter, the working implement 24 may be a bucket, so long as the working implement system 14 or the working machine 12 does not include or is otherwise without a position sensor (e.g., an angular rotation sensor, such as anisotropic magneto-resistive (AMR) sensor) or the like, for instance, between the stick 28 and the bucket, to determine when the bucket is tilted or rotated to dump or discharge its load. And even if such position sensor (such as the AMR sensor) is provided the operator may access a setting using the operator interface 44 to invalidate any signals from such position sensor. According to one or more embodiments, the setting may be a so-called "Free" state setting, which can negate any signaling from the AMR sensor or the like.

Incidentally, the payload for the working implement 24 according to one or more embodiments of the disclosed subject matter can be timber, a vehicle to demolish, or an already demolished vehicle, as examples. Optionally, according to embodiments of the disclosed subject matter, dirt or soil or the like (e.g., other fine or granular material) may not constitute the payload for the working implement 24.

Optionally, the working machine 12 can have a communication system 48. The communication system 48 can communicate, for instance, wirelessly, with the back office system 50 and/or other machines or vehicles at the work site, such as one or more haul trucks at the work site. The communication system 48 can be implemented in or using circuitry. Among other information or data, load or payload data may be transmitted from the working machine 12, for instance, to the back office system 50, via the communication system 48.

Figure 2:
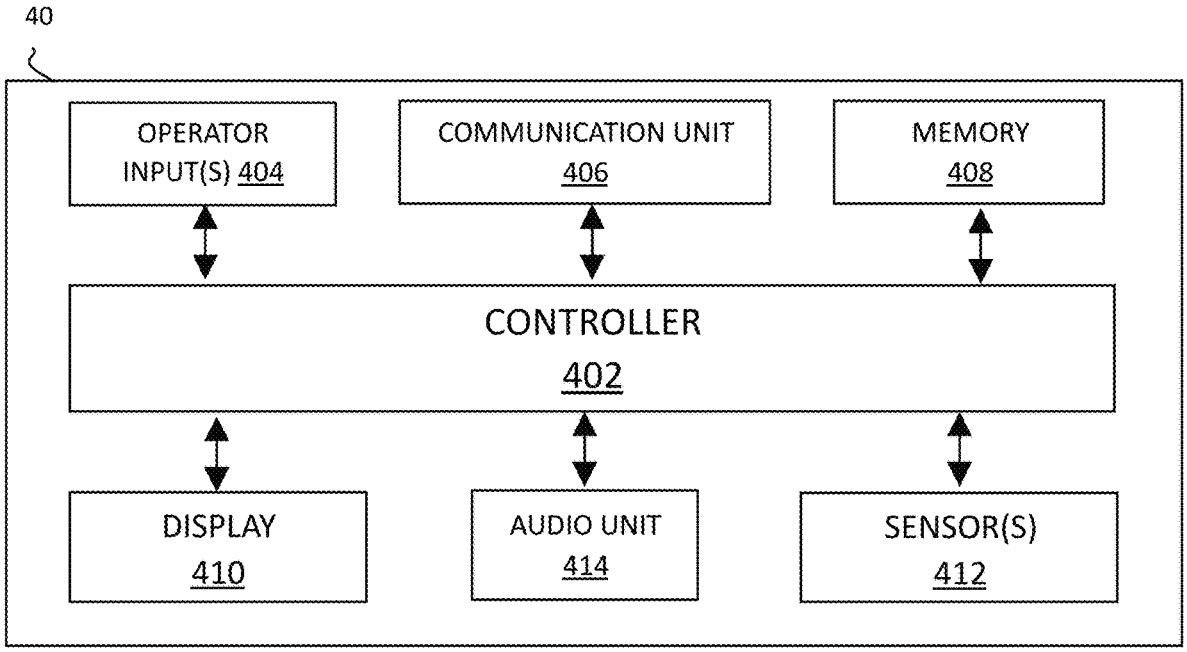
FIG. 2 is a block diagram of a control system according to one or more embodiments of the disclosed subject matter.

Turning now to FIG. 2, FIG. 2 is a block diagram of the control system 40, according to one or more embodiments of the disclosed subject matter. The control system 40 can include a controller 402, which may be implemented in or using control circuitry, one or more operator inputs 404, a communication unit 406, memory 408, one or more displays 410, and one or more sensors 412. The control system 40 may also include an audio system or unit 414.

The memory 408 may be operatively coupled to the controller 402 and may reside outside of the controller 402, such as shown in FIG. 2, and/or within the controller 402, i.e., as part of the controller 402. Generally, the memory 408 can receive and save therein data or information regarding operation of the working machine 12. As an example, the memory 408 can receive and save therein a total or tally of material payload discharged or dumped from the working implement 24 at one or more proper discharge or dump locations.

The communication unit 406 may be (or may be part of) the communication system 48. In this regard, the communication unit 406 can include transmit circuitry to transmit information or data, such as load or payload data, to the back office system 50. Optionally, the communication unit 406 can have receive circuitry to receive information or data from the back office system 50, for instance. The communication unit 406 can communicate, for instance, wirelessly, with the back office system 50 and/or other machines or vehicles at the work site, such as one or more haul trucks at the work site. Optionally, according to one or more embodiments, a total or tally of material payload discharged or dumped from the working implement 24 at one or more proper discharge or dump locations, for instance, retrieved from the memory 408, may be transmitted to the back office system 50 via the communication unit 406 and saved at the back office system 50. The communication unit 406 may also receive data or information (including instructions), for instance, from the back office system 50 and/or other machines or vehicles at the work site.

The audio unit 414 may be comprised of one or more audio speakers, for instance, provided in the operator station 42, to output audible information, such as alerts, to the operator of the working machine 12. As an example, the audio unit 414 can output an audible alert that a haul truck being filled by the working machine 12 has become full.

The one or more sensors 412 can include a position sensor associated with rotation or swing of the working implement system 14 (and the chassis 13) about an axis; a position sensor associated with articulation of the working implement system 14, i.e., extending or retracting the working implement system 14, particularly to identify a position of the working implement 24, for instance, relative to the chassis 13; and a load sensing sensor to sense a payload or added load on the working implement 24. The load sensing sensor may also be used to sense a reduction in the payload, for instance, down to an initial load value to signify that a discharge or dump event has occurred. Optionally, the discharge or dump event may be verified by the cotemporaneous occurrence of a grapple release command initiated by the operator, for instance, using the manual control device 46 or the operator interface 44. As noted above, the one or more sensors 412 may not include—effectively or in fact—a position sensor (e.g., an angular rotation sensor) or the like between the edge of the stick 28 and the working implement 24 to determine when the working implement 24 is tilted or rotated to dump or discharge its payload. Outputs from the one or more sensors 412 may be fed back to the controller 402. Optionally, information from at least one of the one or more sensors 412 may be displayed on the display 410.

The operator input(s) 404 can be (or can be part of) the operator interface 44 and/or the manual control device 46. Operator input to the operator interface 44 can be to set or define a working area and a dumping or discharge area proximate the working machine 12. This may involve setting one or more boundaries between the working area and the discharge area using the operator interface 44. Operator input to the operator interface 44 can also be to enable or activate accurate payload transfer control operations for the working machine 12 according to embodiments of the disclosed subject matter. Operator input to the manual control device 46 can be to control operations of the working machine 12. For instance, operator input to the manual control device 46 can control rotation or swing of the working implement system 14 (and the chassis 13) about the axis, articulation of the working implement system 14, i.e., extending or retracting the working implement system 14 relative to the chassis 13, and grasping and releasing by the working implement 24. The controller 402 can output control signaling to various system components (e.g., hydraulic systems, electrical systems, etc.) to control movement of the working machine 12 responsive to operator inputs to the manual control device 46.

According to one or more embodiments, at least one of the one or more of the displays 410 devices may constitute or be part of the operator interface 44. In this regard, such at least one display 410 may be implemented on a display device operative to display a graphical user interface (GUI). Optionally, the one or more displays 410 may output an alert, for instance, an alert indicating that a haul truck being filled by the working machine 12 is full.

FIGS. 3-7 show exemplary operator interfaces 44, which may be provided on at least one display 410, and which may be implemented on a display device operative to display a graphical user interface (GUI), according to one or more embodiments of the disclosed subject matter.

Figure 3:
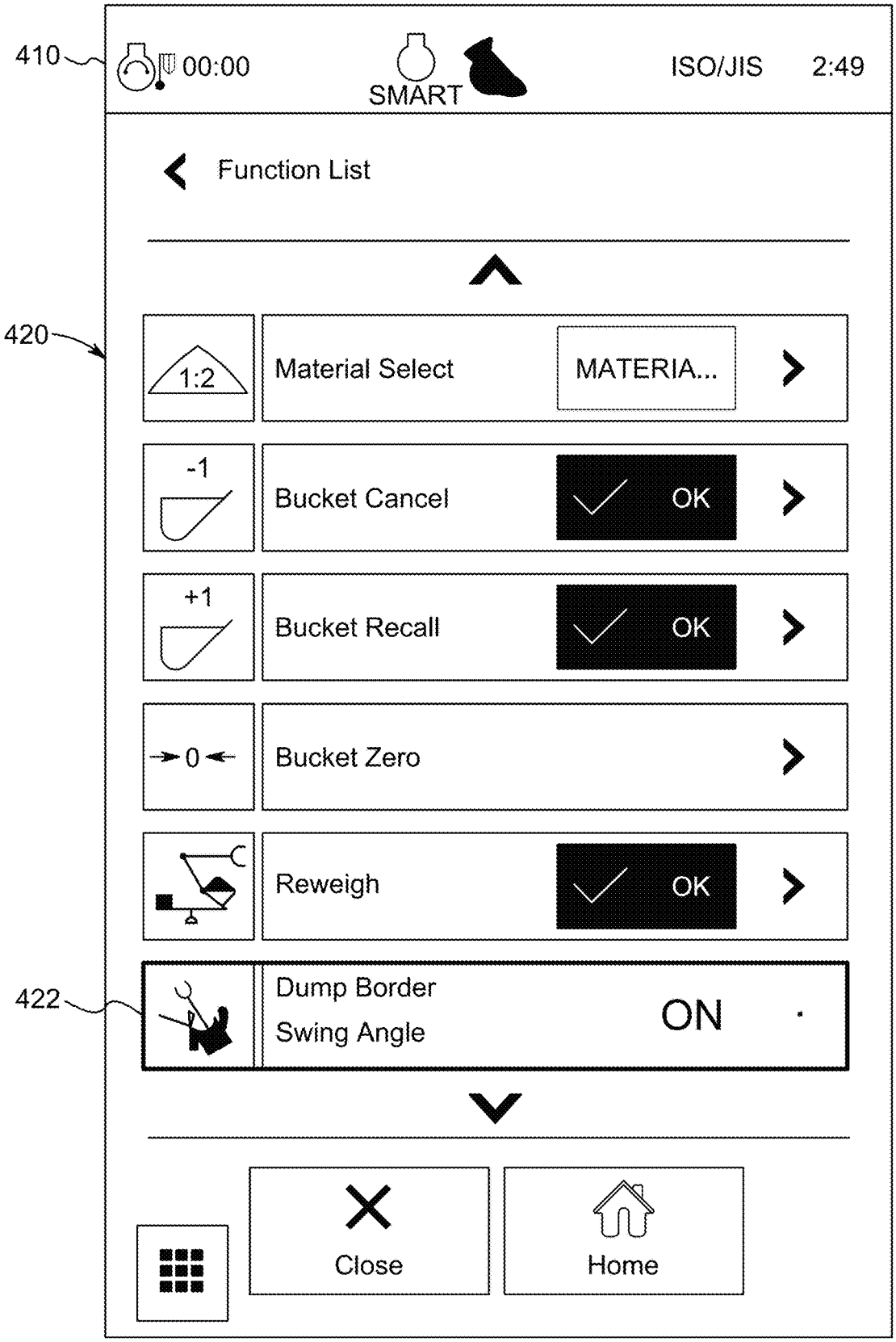
FIGS. 3-7 show exemplary operator interfaces according to one or more embodiments of the disclosed subject matter.

As shown in FIG. 3, the display 410 may display a menu 420. Generally, the menu 420 may be referred to or characterized as a function menu or list. Among other features, the menu 420 can display an option 422 to enable or activate a dump or discharge border swing angle feature according to embodiments of the disclosed subject matter. The option 422 may be displayed on the menu 420 in a case where a particular type of working implement 24 is used. As noted above, such particular type of working implement 24 may be a grapple, a clamshell, or a bucket in a case without a position sensor (e.g., an angular rotation sensor) or the like between edge of the stick 28 and the bucket to determine when the bucket is tilted or rotated to dump or discharge its load. In this example, the option 422 shows a status of the dump or discharge border swing angle feature. The operator may provide an input to the menu 420 to change the status of the dump or discharge border swing angle feature, for instance, toggling from ON to OFF or vice versa.

Figure 4:
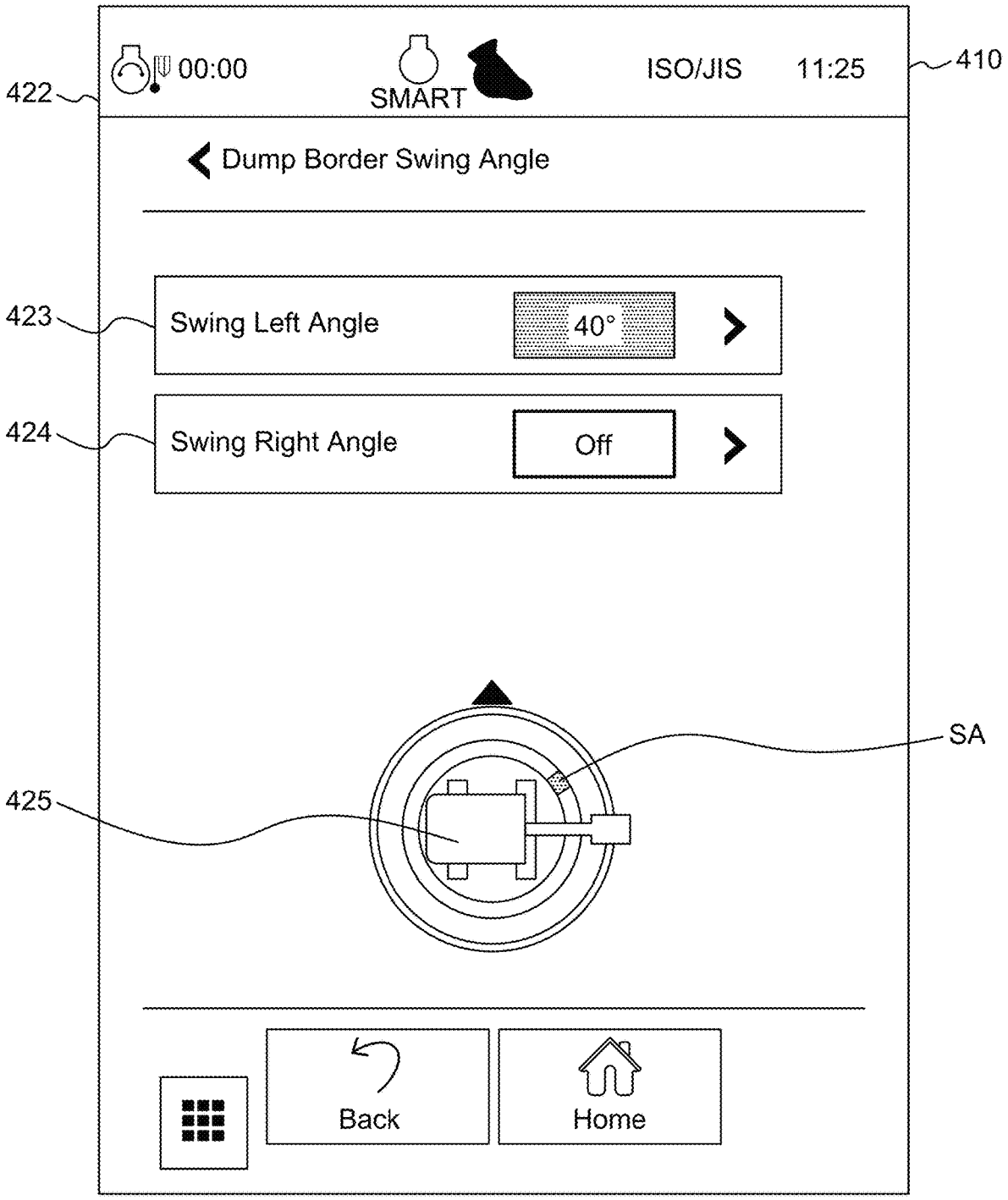
Figure 5:
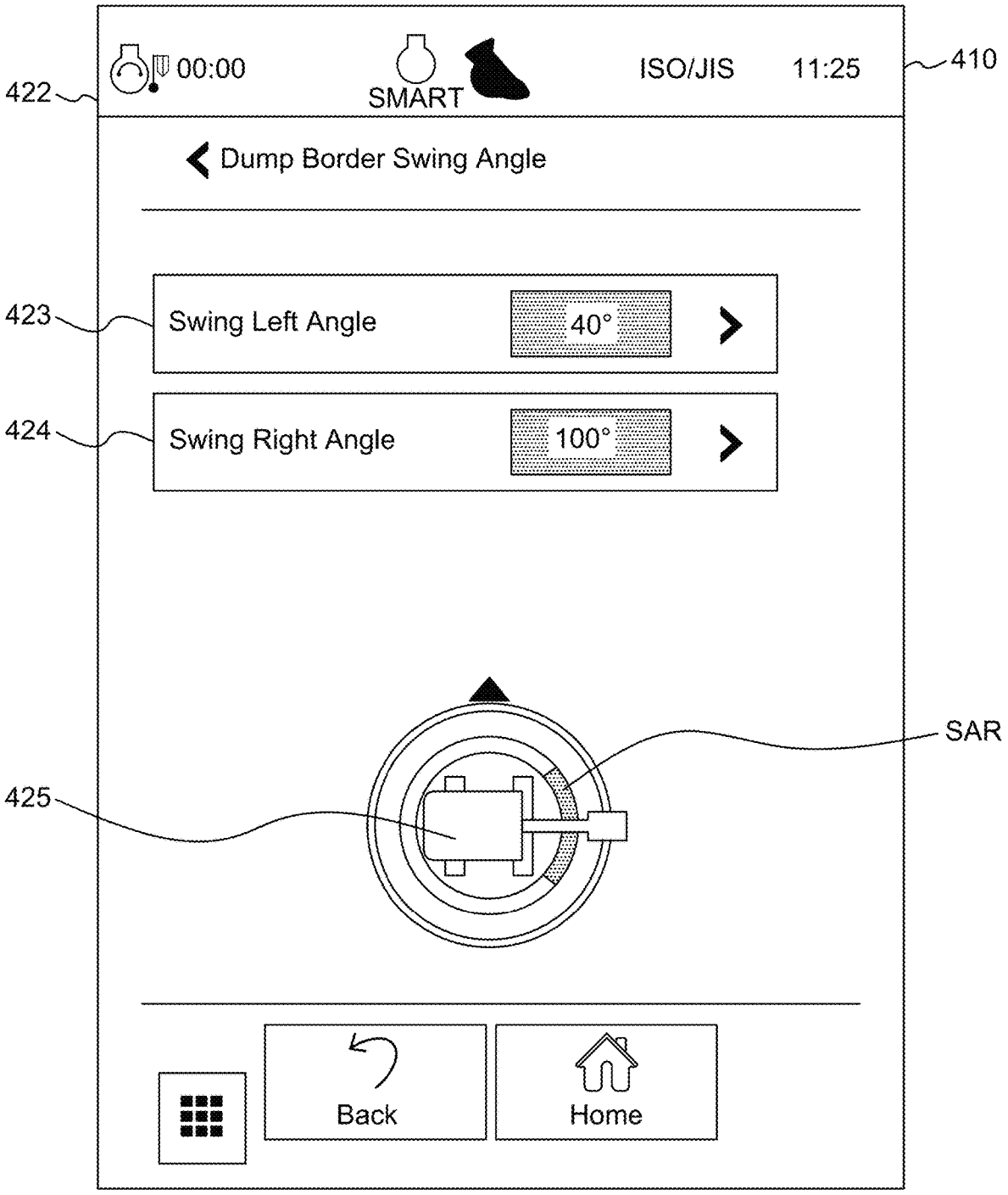

The operator may also provide an input to option 422 to access more information regarding the dump or discharge border swing angle feature and to even set (or set again) one or more swing angles of the working implement 24 to define a discharge or dump area (and by default a working area), or at least a transition or border between the discharge or dump area from the working area (in the case of only one swing angle being set). For instance, FIG. 4 shows the display 410 displaying the setting of one swing angle set upon accessing option 422, whereas FIG. 5 shows the display 410 displaying the setting of two swing angles upon accessing option 422. Swing angle may also be referred to as turn or turning angle of the working implement 24.

The swing angle or angles may be set via inputs to the display 410. For instance, the operator may control the swing position of the working implement 24 to be positioned relative to an edge of a desired dumping or discharging area, for instance, an area where a haul truck is or will be to receive the payload from the working implement 24. Once the working implement 24 is at the position, the operator can select either a Swing Left Angle icon 423 or a Swing Right Angle icon 424, depending upon whether the desired boundary needs to swing left or right once inside the discharge area to reach the set angle, to set the particular swing angle. Optionally, only one of the left swing angle or the right swing angle may be set, such as shown in FIG. 4. Alternatively, after setting one of the left swing angle or the right swing angle, the operator may control the working implement 24 to swing to another angle to set the other of the left swing angle or the right swing angle, such as shown in FIG. 5.

Also shown in FIG. 4 and FIG. 5, the set swing angle(s) may appear on a working machine icon 425 on the display 410. For the setting of a single swing angle, a single swing angle marking SA, which may be in the form of a circle or dot, may appear on the working machine icon 425 at the set swing angle. The numerical angle value shown on the display 410 in association with Swing Left Angle icon 423 or a Swing Right Angle icon 424 may be a value that is relative to a base or starting angle of the working implement 24 of the working machine 12. The base or starting angle may be normalized to a zero angle. Of course, the forty degrees setting is merely an example. The set swing angle, whether the left or the right, can define entry into the discharge area (from the working or grab area).

Here, in the example shown in FIG. 4, the zero angle is at a twelve o'clock position, though embodiments of the disclosed subject matter are not so limited. Thus, in this example, the left swing angle is set at forty degrees (clockwise) from the twelve o'clock position.

In the case of setting two swing angles, such as shown in FIG. 5, a swing angle range marking SAR, which may be in the form of an arc, may appear on the working machine icon 425 at the set swing angle range between the two set swing angles. The swing angle range marking SAR can indicate the swing angle range of the discharge or dump area (the working area can be defined as the remaining angles outside of the arc).

In the example shown in FIG. 5, the left swing angle is set at forty degrees (clockwise) from the twelve o'clock position and the right swing angle is set at one hundred degrees (clockwise) from the twelve o'clock position. Thus, the discharge area can be set between the swing angles of forty degrees and one hundred degrees.

In some respects, the swing left angle may be referred to or characterized as a first swing angle the working implement 24 will reach when traveling clockwise from the working area and the swing right angle may be referred to or characterized as a second swing angle the working implement 24 will reach when traveling clockwise. The reverse may be true when the working implement 24 is swung in the opposite direction.

Figure 7:
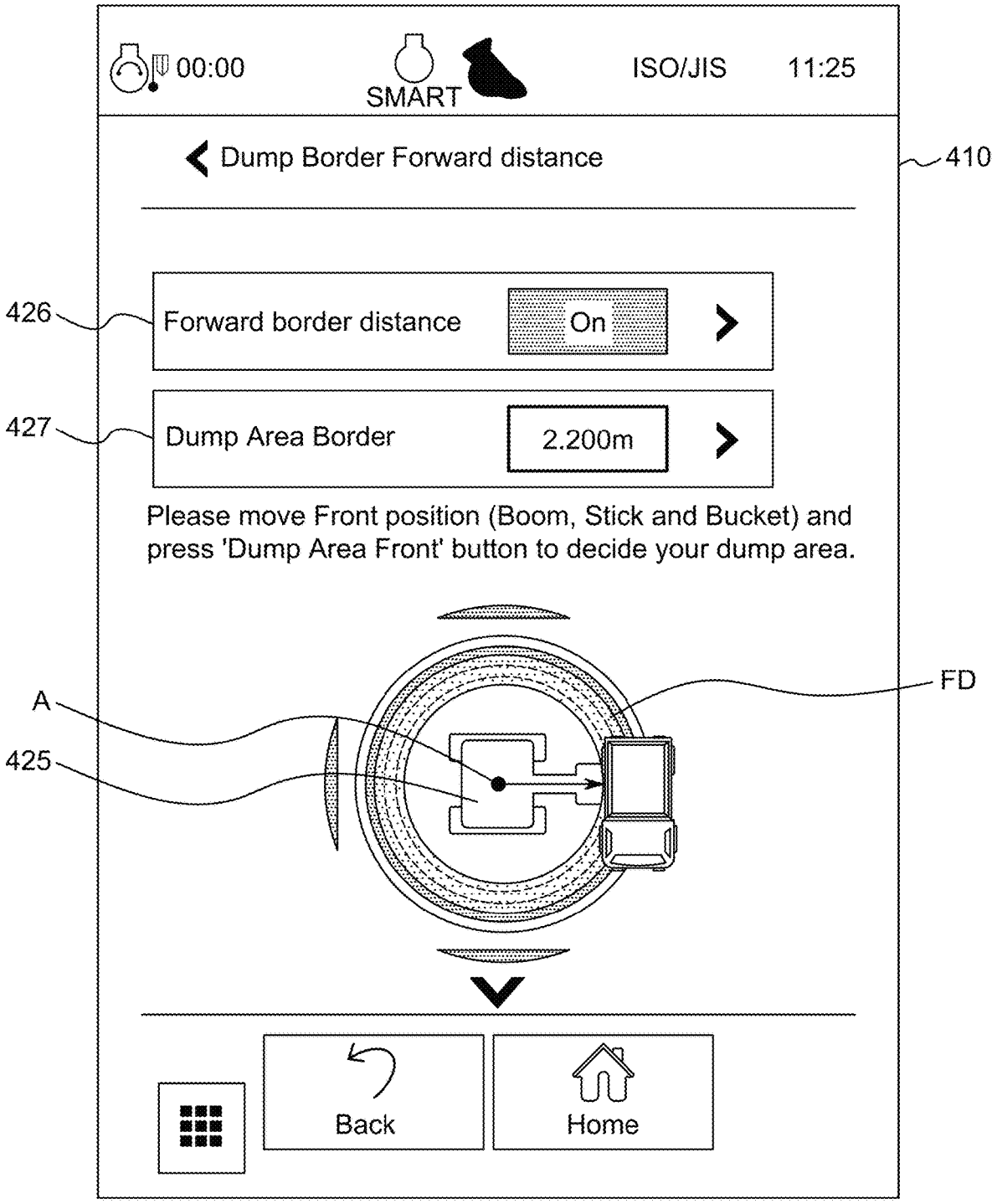

Referring now to FIG. 7 and FIG. 8, the menu 420 of display 410 may also display an option 426 to enable or activate a dump or discharge border forward distance feature according to embodiments of the disclosed subject matter. The forward distance can refer to an amount by which the working implement 24 needs to be radially articulated or extended to reach a dump or discharge area. Such option 426 may be displayed on the menu 420 in a case where a particular type of working implement 24 is used. As noted above, the particular type of working implement 24 may be a grapple, a clamshell, or a bucket in a case without a position sensor (e.g., an angular rotation sensor) or the like between an edge of the stick 28 and the bucket to determine when the bucket is tilted or rotated to dump or discharge its load. In this example, the option 426 can show a status of the dump or discharge border forward distance feature. The operator may provide an input to the menu 420 to change the status of the dump or discharge border forward distance feature, for instance, toggling from ON to OFF or vice versa.

The operator may also provide an input to option 426 of the menu 420 to access more information regarding the dump or discharge border forward distance feature and to even set (or set again) the dump or discharge border to define a discharge or dump area (and by default a working area) around the working machine 12. Accessing option 426, at least initially, can show a current setting for the dump or discharge border forward distance. In the example shown in FIG. 7 the distance is set at 2.0 m from an axis A about which the working implement system 14 rotates. In this example, the axis A is shown on the working machine icon 425.

The dump or discharge border forward distance may be set via inputs to the display 410. For instance, the operator may control amount by which the working implement 24 is radially extended relative to an edge of a desired dumping or discharging area, for instance, an area where a haul truck is or will be to receive the pay load from the working implement 24. Once the working implement 24 is at the position, the operator can select a Dump Area Border icon 427 to set the dump or discharge border forward distance value. The distance may be set around an entirely of the working machine 12. Thus, a circle having a radius of the dump or discharge border forward distance value may be defined around the working machine 12 to delineate the working area inside the circumference of the circle and the dumping area outside the circumference of the circle.

Also shown in FIG. 7, the set dump or discharge border forward distance value may appear on the working machine icon 425 on the display 410. In the example shown in FIG. 7, a forward distance marking FD provided entirely around the working machine icon 425 can be displayed on the display 410.

Figure 6:
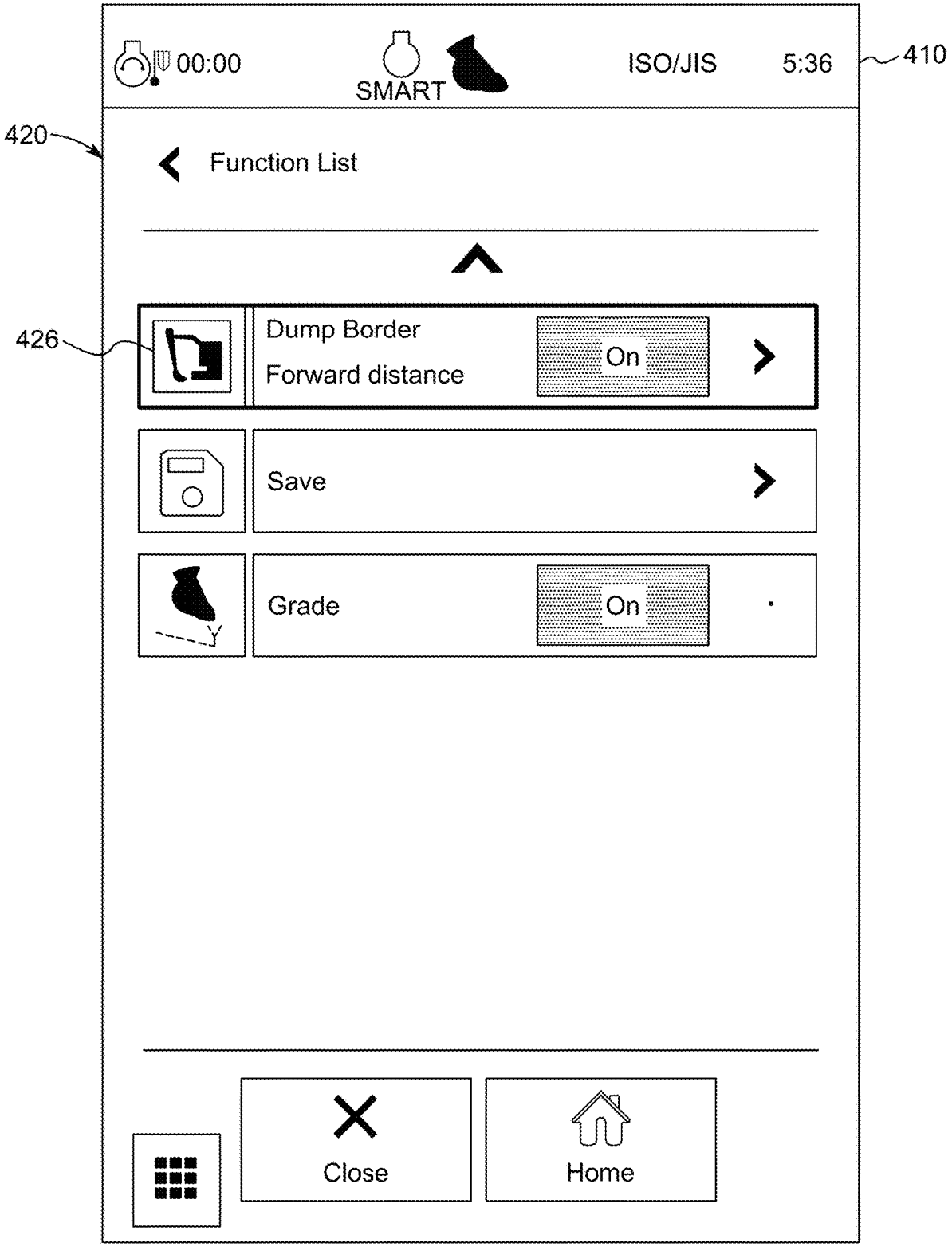

Though FIG. 5 and FIG. 6 and corresponding description discuss embodiments to set swing angle(s) and FIG. 7 and corresponding description discuss embodiments to set forward distance, embodiments of the disclosed subject matter are not limited to either one or the other. Rather, the two methodologies may be combined. In particular, the operator can set both the dump or discharge border forward distance in combination with one or both of the swing angles. Thus, the borders of the dump or discharge area set by the user may be defined based on swing angle and radius/circumference. In an example, the dump or discharge area may be a rainbow shape, depending upon the selected swing angles.

INDUSTRIAL APPLICABILITY

As noted above, embodiments of the disclosed subject matter can involve accurately determining or identifying proper payload transfer from a working implement of a working machine. Additionally or alternatively, embodiments of the disclosed subject matter can involve accurately determining or identifying improper payload transfer from the working implement. Embodiments of the disclosed subject matter can separate a working or grabbing area where a working machine, such as working machine 12, can pick up payload from a discharging or dumping area where the working machine 12 can dump the payload. Counting discharge of the payload only when the working implement 24 of the working machine 12 is determined to be in the discharging area can prevent miscounting of discharges, particularly those made outside of the discharging area. However, even if the working machine 12 is determined to be in the discharging area, the payload may not be counted in a case that the working machine 12 grabs the payload and lifts it up in the discharging area. This is to prevent the payload that has already been counted from being double-counted when the payload that have been dumped (e.g., loaded on the truck or the like) are rearranged and reloaded in the discharging area. In this case, dump material payload count may increase by leaving the discharging area and re-entering the discharging area again.

A working machine, such as the working machine 12, according to embodiments of the disclosed subject matter, can have the operator station 42. The operator interface 44 and the manual control device 46 to control the working machine 12 can be provided in the operator station 42. The operator interface 44 and the manual control device 46 can be operatively coupled to the control system 40. The operator interface 44 may be a control panel, for instance, implemented on a display device operative to display a graphical user interface (GUI) providing some or all of the operator interface 44. Such operator interface may be implemented using multiple display devices. Alternatively, the operator station 42 (and thus the operator interface 44 and the manual control device 46) may be provided offboard the working machine 12, for instance, at the back office system 50.

The manual control device 46 can control rotation of the chassis 13, the operator station 42, and the working implement system 14, for instance, relative to the drive system 16. Such rotation may be about an axis in an overhead plan view of the working machine 12. The manual control device 46 may also control movement of the working implement system 14 relative to the chassis 13. For instance, the manual control device 46 may be operated to move the working implement system 14 to an outermost or most extended position (i.e., as far away from the chassis 13 and/or operator station 42 as possible) and to move the working implement system 14 to an innermost or least extended position (i.e., as close to the chassis 13 and/or the operator station 42 as allowed). Such movement may be characterized as or considered to be in a radial direction. Thus, the working implement system 14 can be radially extendable and retractable to and from outermost and innermost positions, respectively.

The working implement 24 may be or include a clamshell or a grapple, such as shown in FIG. 1. In the case of the grapple or the clamshell as the working implement 24, optionally, the working implement system 14 may be without a position sensor to sense opening of the grapple tongs 38 (or shells) to dump or discharge its payload. Alternatively, according to embodiments of the disclosed subject matter, the working implement 24 may be a bucket, so long as the working implement system 14 or the working machine 12 does not include or is otherwise without a position sensor (e.g., an angular rotation sensor, such as anisotropic magneto-resistive (AMR) sensor) or the like, for instance, between the stick 28 and the bucket, to determine when the bucket is tilted or rotated to dump or discharge its load. And even if such position sensor (such as the AMR sensor) is provided the operator may access a setting using the operator interface 44 to invalidate any signals from such position sensor. According to one or more embodiments, the setting may be a so-called "Free" state setting, which can negate any signaling from the AMR sensor or the like.

As noted above, a working area and a discharge or dumping area around the working machine 12 can be set using the operator interface 44, for instance. The working area may be referred to or characterized as a grab area where the working machine 12 picks up or re-grabs payload, such as timber, to be discharged or dumped into another area, for instance, into a haul truck. The area where the payload is supposed to be discharged or dumped may be referred to as the discharge or dumping area. Moreover, in that the operator can specifically set the boundaries for the discharge or dumping area, such area may be referred to as a proper discharge or dumping area. Generally, the grab area and the dump area can be separated by one or more swing angles and/or by a radial distance from the working machine 12. In that the discharge or dumping area can be set in advance, at least with respect to some payload transport, the working area and the discharge or dumping area can be referred to or characterized as present areas, defined by preset boundaries.

Figure 9:
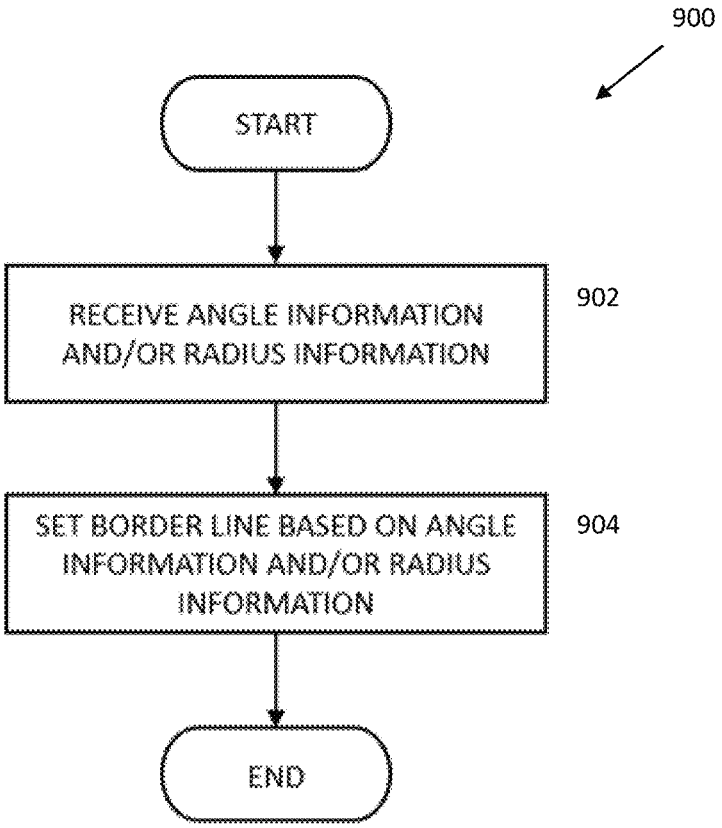
FIG. 9 is a block diagram of a method according to one or more embodiments of the disclosed subject matter.

FIG. 9 is a block diagram of a method 900 according to one or more embodiments of the disclosed subject matter. Generally, method 900 may be representative of setting the discharge or dump area, and hence the working or grabbing area, for the working machine 12, as discussed above. At 902, the method can receive inputs to an operator interface, such as operator interface 44, to set the swing angle(s) and/or the dump or discharge border forward distance. At 904 the border(s) between the discharge or dump area and the working or grabbing area can be set responsive to the inputs to the operator interface. The discharge/dump area may be displayed on a display, such as display 410. Some or all of the method 900 can be performed via a non-transitory computer-readable storage medium having stored thereon instructions that, when executed by one or more processors, causes the one or more processors to perform the method 900.

Figure 10:
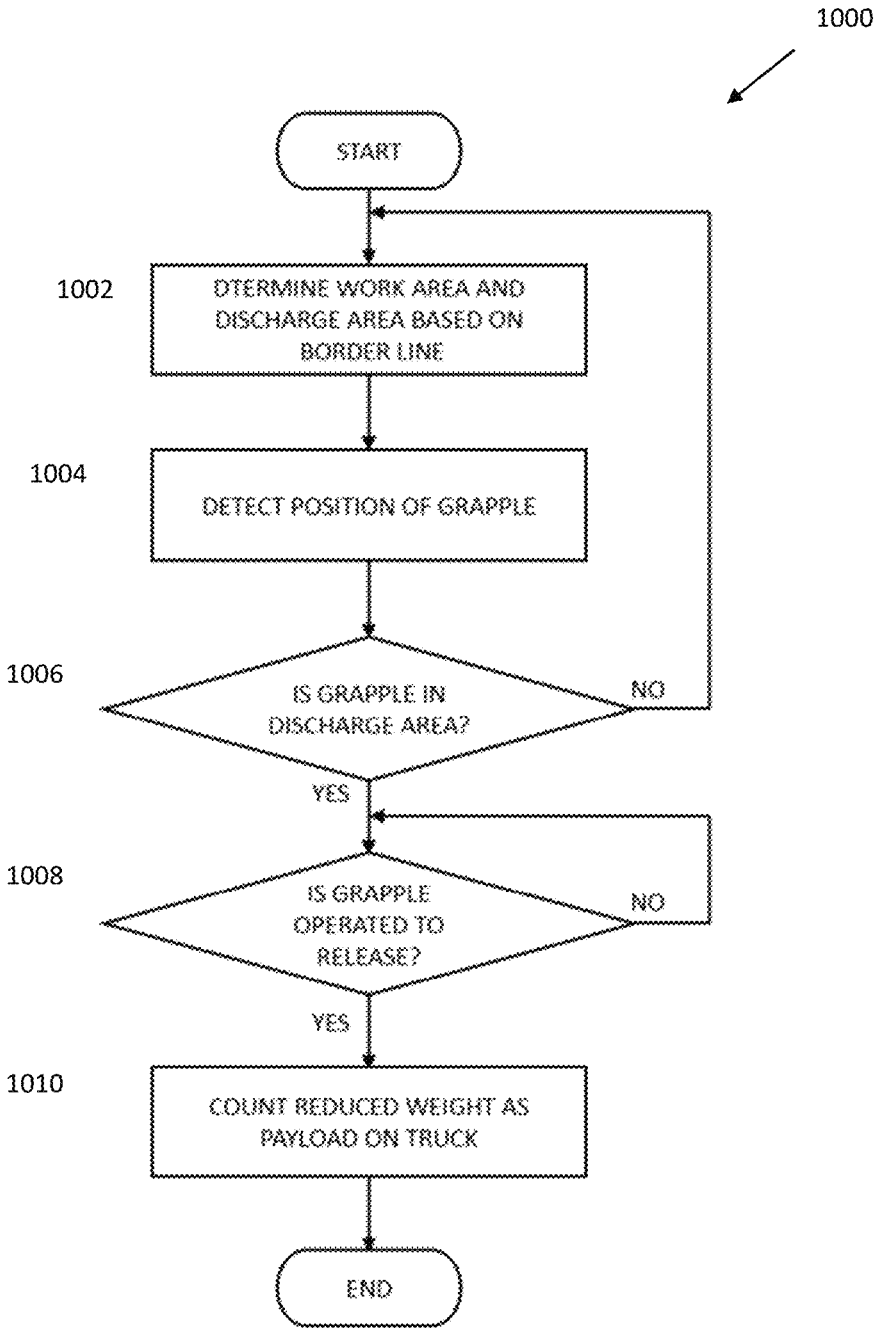
FIG. 10 is a block diagram of another method according to one or more embodiments of the disclosed subject matter.

FIG. 10 is a block diagram of a method 1000 according to one or more embodiments of the disclosed subject matter. Regarding operation, the method 1000 may involve, at 1002, determining the working area and the discharge or dumping area. As an example, the controller 402 may refer to or retrieve such information from the memory 408.

With the working implement 24 in the preset working area, the working machine 12 can identify a grab or pick up event whereby the working implement 24 grabs material in the working area for transport to a discharge or dump area. As an example, the controller 402 can receive load signals indicative of an increase in load on the working implement 24 as the working implement picks up or grabs the payload. The load (or weight) signals may be provided from corresponding sensors of the working implement system 14.

With the payload, the working implement 24 can be moved toward a predetermined discharge or dump area, set as discussed above. Such movement of the working implement 24 may be by way of swinging or turning the working implement 24 about the axis A of the working machine 12 and/or by way of radially extending the working implement away from the axis A of the working machine 12.

As the working implement 24 with the payload is moving toward the discharge area, a load discharge event may occur. Such load discharge event may also be referred to as a candidate dumping event. The load discharge event may be detected by the controller 40 based on signals from the load (or weight) sensors of the working implement system 14. According to one or more embodiments, reduction of the load on the working implement system 14 by a predetermined amount, or an event that the load is less than a minimum payload value which may be preset on a product model basis, may be determined by the controller 402 to constitute the load discharge event (or candidate dumping event). For instance, the load discharge event may be detected when the measurement target weight of the load changes below a preset threshold value (i.e., when the load becomes lighter) and optionally by looking at opening and closing of a thumb wheel. Optionally, presence of a grapple release command, for instance, issued via the operator interface 44 or the manual control device 46, may be factored in by the controller 402 to determine or confirm the load discharge event. Incidentally, the grapple release command can be representative of whether or not a release event has been detected.

At 1004, the method 1000 can include detecting or determining, for instance, using one or more position sensors of the working machine 12 (e.g., of the working implement system 14), a position of the working implement 24 at a time of detection of the load discharge event (or the candidate dumping event). As an example, the controller 402 can receive position signaling from the one or more position sensors of the working machine 12 (e.g., of the working implement system 14) regarding the position of the working implement 24 at the time of detection of the load discharge event (or the candidate dumping event).

At 1006, the method 1000 can include determining whether the detected position of the working implement 24 at the time of detection of the load discharge event (or the candidate dumping event) is in the working area or in the discharge area. As an example, the controller 402 may compare the position information of the working implement with the preset boundaries of the discharge area.

In a case where the load discharge event is determined to have occurred in the working area, i.e., not in the discharging area, the load discharge event (or the candidate dumping event) may be invalidated as a proper discharge. That is, it may be identified that the load discharge event did not occur where it was supposed to occur, for instance, outside a haul truck. Therefore, a dump material payload count or tally may not be increased by the controller 402. Rather, the dump material payload count or tally can be maintained or omitted from registration. The dump material payload count or tall may be stored in the memory 408 and may not be updated.

In a case where the load discharge event is determined to have occurred in the discharging area, the load discharge event (or the candidate dumping event) may be validated as a proper discharge. That is, it may be identified that the load discharge event did occur where it was supposed to occur, for instance, inside the haul truck. Therefore, the dump material payload count or tally, at 1010 of the method 1000, may be increased by the controller 402. The dump material payload count or tally may be increased by the specific amount of the particular payload, as measured from load/weight sensor(s) of the working implement system 14. The updated dump material payload count or tally may be saved in the memory 408. Optionally, the dump material payload count or tally, as updated, may be sent offboard the working machine 12, for instance, to the back office system 50. Optionally, according to one or more embodiments, such increase, i.e., counting the valid discharge, can be performed when the working implement 24 is still in the discharge area. That is, the dump material payload amount may be determined without the need for the working implement 24 to return to the working area. Such counting of the dump material payload may be performed automatically. Incidentally, an icon or alert on the operator interface 44, for instance, may activate to indicate to the operator that t the dump material payload may be increased in case that the working implement 24 discharges the load in the discharge area.

Optionally, the controller 402 can keep track, based on the running tally of the dump material payload count, how much material has been discharged in the discharge area. Hence, the controller 402 may know and identify when a particular vehicle, such as a haul truck, has become filled due to proper discharge of payload from the working implement 24.

Figure 8A:
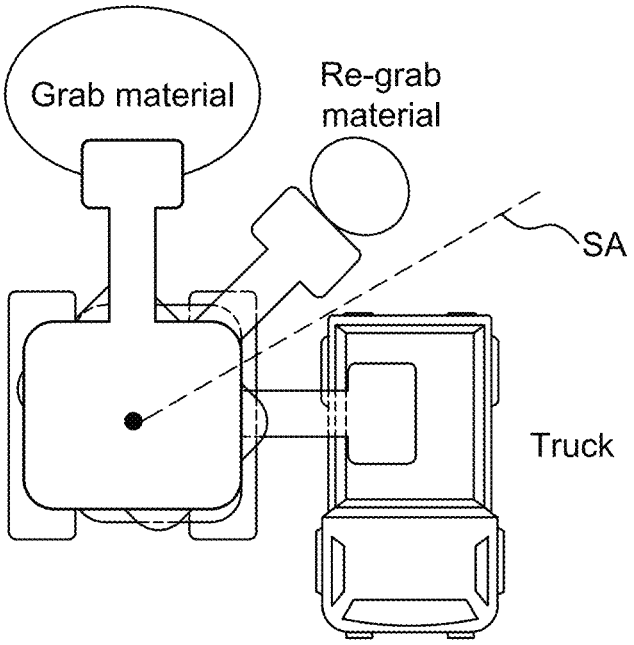
FIGS. 8A and 8B are diagrams of exemplary operations of a working machine according to one or more embodiments of the disclosed subject matter.
Figure 8B:
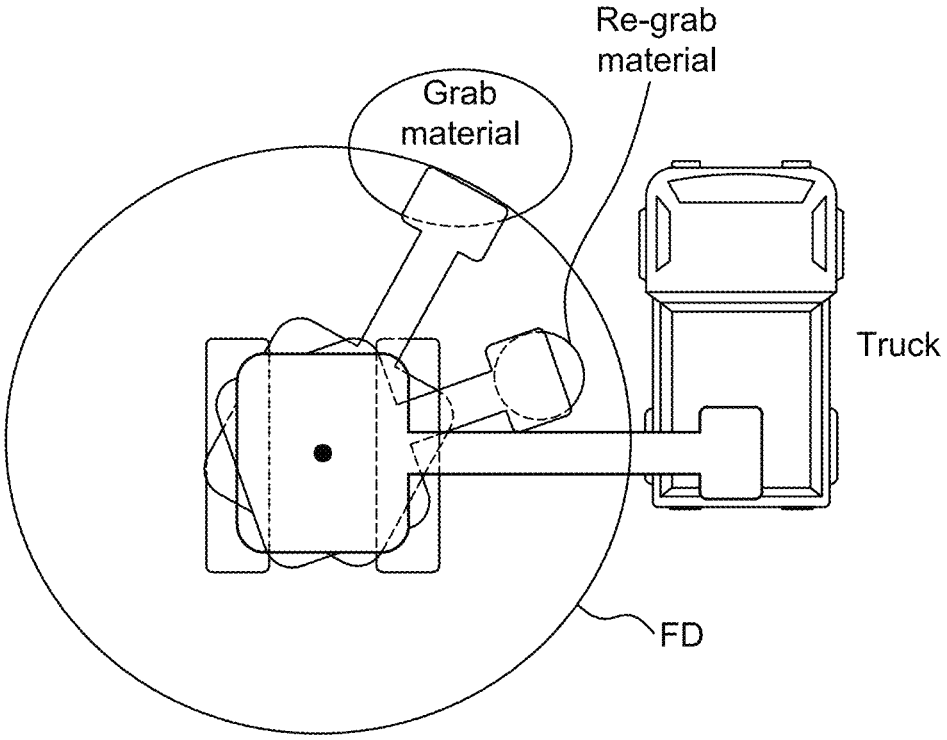

Turning now to FIG. 8A and FIG. 8B, these figures are diagrams of exemplary operations of the working machine 12 according to one or more embodiments of the disclosed subject matter.

FIG. 8A shows an example regarding a set swing angle SA. Notably, the working implement 24 can grab material with the intent of swinging the material to be discharged in the haul truck. Before reaching the haul truck the material may fall from the working implement 24 and need to be picked up. The operator may know that the material did not reach the haul truck. However, due to the reduction of load on the working implement 24, the system may otherwise add the amount of the payload to the tally of dump material payload count. Instead, because the candidate discharge event occurs outside of the discharge area, as defined by the swing angle SA border, the system can know not to add the amount of the payload to the tally of the dump material payload count. Rather, only after the discharge event is determined to occur within the discharge area will the payload amount be added to the tally of the dump material payload count.

The operation shown in FIG. 8B is similar to that shown in FIG. 8A, however, the operation in FIG. 8B pertains to a set forward distance shown by the forward distance marking FD around the working machine 12. Notably, discharge events occurring inside the forward distance shown by the forward distance marking FD may not be added to the tally of the dump material payload count, whereas discharge events occurring outside the forward distance shown by the forward distance marking FD, i.e., in the discharge area, may be added to the tally of the dump material payload count.

As will be appreciated by one skilled in the art, aspects of the present disclosure may be embodied as a system, method, or computer program product. Accordingly, aspects of the present disclosure may take the form of an entirely hardware embodiment, an entirely software embodiment (including firmware, resident software, micro-code, etc.) or an embodiment combining software and hardware aspects that may all generally be referred to herein as a "circuit," "circuitry," or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, radiofrequency, and the like, or any suitable combination of the foregoing. Computer program code for carrying out operations for aspects of the present disclosure may be written in any combination of one or more programming languages, including an object oriented programming language and conventional procedural programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of the present disclosure have been described above with reference to flowchart illustrations and/or block diagrams of methods, apparatus (systems) and computer program products according to embodiments of the present disclosure. In this regard, the flowchart and block diagrams in the Figures illustrate the architecture, functionality, and/or operation of possible implementations of systems, methods, and computer program products according to various embodiments of the present disclosure. For instance, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

It also will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks. The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

Thus, the functionality of the elements disclosed herein may be implemented using circuitry or processing circuitry which can include general purpose processors, special purpose processors, integrated circuits, ASICs ("Application Specific Integrated Circuits"), conventional circuitry and/or combinations thereof which are configured or programmed to perform the disclosed functionality. Processors can be considered processing circuitry or circuitry as they include transistors and other circuitry therein. The processor may be a programmed processor which executes a program stored in a memory. In the disclosure, the circuitry, units, or means are hardware that carry out or are programmed to perform the recited functionality. The hardware may be any hardware disclosed herein or otherwise known which is programmed or configured to carry out the recited functionality. When the hardware is a processor which may be considered a type of circuitry, the circuitry, means, or units are a combination of hardware and software, the software being used to configure the hardware and/or processor.

As used herein, the term "circuitry" can refer to any or all of the following: (a) hardware-only circuit implementations (such as implementations in only analog and/or digital circuitry); (b) to combinations of circuits and software (and/or firmware), such as (as applicable): (i) a combination of processor(s) or (ii) portions of processor(s)/software (including digital signal processor(s)), software and memory(ies) that work together to cause an apparatus, such as a mobile phone or server, to perform various functions); and (c) to circuits, such as a microprocessor(s) or a portion of a microprocessor(s), that require software or firmware for operation, even if the software or firmware is not physically present. Controller, as used herein, may be implemented in or using circuitry.

This interpretation of "circuitry" can apply to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a network device.

Instances of the terms "data," "content," "information," and similar terms may be used interchangeably, according to some example embodiments of the present disclosure, to refer to data capable of being transmitted, received, operated on, and/or stored. The term "network" may refer to a group of interconnected computers or other computing devices. Within a network, these computers or other computing devices may be interconnected directly or indirectly by various means including via one or more switches, routers, gateways, access points or the like.

While aspects of the present disclosure have been particularly shown and described with reference to the embodiments above, it will be understood by those skilled in the art that various additional embodiments may be contemplated by the modification of the disclosed machines, assemblies, systems, and methods without departing from the spirit and scope of what is disclosed. Such embodiments should be understood to fall within the scope of the present disclosure as determined based upon the claims and any equivalents thereof.

The invention claimed is:

1. A working machine comprising:

a chassis;

an operator station supported by the chassis, the operator station including an operator interface and a manual controller to control the working machine;

a grapple supported by the chassis, the grapple and the operator station being rotatable about an axis in an overhead plan view of the working machine, and the grapple being radially extendable and retractable to and from outermost and innermost positions, respectively; and a controller configured to control movement of the grapple responsive to operator input using the manual controller of the of the operator station, determine a position of the grapple relative to predetermined working and dumping areas for the working machine defined by at least one preset boundary between the working area and the dumping area, identify a candidate dumping event for the grapple based on a decrease in a load on the grapple, determine whether the determined position of the grapple is in the working area or the dumping area responsive to the identification of the candidate dumping event, characterize the candidate dumping event as an invalid dumping event and maintain a dump material payload count in a first case where the determined position of the grapple is in the working area upon the identification of the candidate dumping event, and characterize the candidate dumping event as a valid dumping event and increase the dump material payload count in a second case where the determined position of the grapple is in the dumping area upon the identification of the candidate dumping event.

2. The working machine according to claim 1, wherein the at least one preset boundary includes a circumference of a circle surrounding the axis, inside the circumference constituting the working area and outside the circle constituting the dumping area.

3. The working machine according to claim 1, wherein the at least one preset boundary includes a first portion of a first radius of a circle surrounding the axis.

4. The working machine according to claim 3, wherein the at least one preset boundary includes a second portion of a second radius of the circle separated from said first portion of the first radius of the circle by a predetermined angle.

5. The working machine according to claim 1, wherein the at least one preset boundary is defined by an angle from a predetermined starting angle of the grapple in the overhead plan view.

6. The working machine according to claim 1, wherein the at least one preset boundary includes at least two preset boundaries, the at least two preset boundaries forming a segment of a circle surrounding the axis.

7. The working machine according to claim 1, wherein the controller is configured to set the at least one preset boundary in response to an input to the operator interface prior to identifying the candidate dumping event.

8. The working machine according to claim 1, wherein the controller is configured to determine when a grapple release command has been issued via the operator interface or the manual controller of the of the operator station, and wherein the identification of the candidate dumping event for the grapple is further based on the determination regarding whether the grapple release command has been issued.

9. The working machine according to claim 1, wherein the controller is configured to determine an immediately subsequent candidate dumping event in the case where said candidate dumping event was characterized as the invalid dumping event and characterize said immediately subsequent candidate dumping event as the valid dumping event and increase the dump material payload count.

10. A method for accurately determining proper payload transfer from a working machine having a grapple or a clamshell, the method comprising:

setting, using a controller, a working area and a discharge area around the working machine responsive to an input to an operator interface of the working machine;

identifying, using the controller, occurrence of a load discharge event for the grapple or the clamshell based on a load on the grapple decreasing by at least a predetermined value;

detecting, using a position sensor of the working machine, a position of the grapple or the clamshell at a time of said identifying the occurrence of the load discharge event;

determining, using the controller, whether the detected position of the grapple or the clamshell at the time of the identification of the occurrence of the load discharge event is in the working area or the discharge area;

maintaining, using the controller, a total discharge material payload amount in a first case where the detected position is determined to be in the working area at the time of the identification of the occurrence of the load discharge event; and increasing and saving in memory, using the controller, the total discharge material payload amount in a second case where the detected position is determined to be in the discharge area at the time of the identification of the occurrence of the load discharge event, the total discharge material payload amount being increased by a load amount of the load discharge event.

11. The method according to claim 10, wherein said setting the discharge area includes setting a turning angle of the grapple or the clamshell of the working machine and/or setting a working radius outside of which is the discharge area.

12. The method according to claim 11, wherein said setting the discharge area includes moving the grapple or the clamshell to a first position and providing a first input to the operator interface of the working machine to set a first boundary of the discharge area followed by moving the working implement to a second position and providing a second input to the operator interface of the working machine to set a second boundary of the discharge area.

13. The method according to claim 10, wherein said increasing and saving in the memory the total discharge material payload amount is performed when the grapple or the clamshell is in the discharge area, and wherein the method further comprises performing, using the controller, a subsequent determination regarding whether the detected position of the grapple or the clamshell at the time of the identification of the occurrence of the load discharge event is in the working area or the discharge area in a case where the grapple or the clamshell has returned to the working area after said increasing and saving in the memory the total discharge material payload amount.

14. The method according to claim 10, further comprising controlling, using the controller, display of a graphical user interface, on a display of the working machine, as the operator interface of the working machine.

15. A non-transitory computer-readable storage medium having stored thereon instructions that, when executed by one or more processors, causes the one or more processors to perform a method comprising:

identifying occurrence of a payload discharge event for a working implement of a working machine;

determining whether a position of the working implement at a time of the identification of the occurrence of the payload discharge event is in a preset working area or a preset discharge area;

omitting the payload discharge event from registration for a tally of discharge material payload amount under a first case where the position of the working implement is determined to be in the working area at the time of the identification of the occurrence of the payload discharge event; and registering the payload discharge event for the tally of discharge material payload amount under a second case where the position of the work implement is determined to be in the discharge area at the time of the identification of the occurrence of the payload discharge event, the tally of the discharge material payload amount being increased by a load amount associated with the load discharge event.

16. The non-transitory computer-readable storage medium according to claim 15, wherein said identifying occurrence of the payload discharge event is performed without feedback regarding angular rotation at an edge of the working implement.

17. The non-transitory computer-readable storage medium according to claim 15, wherein said saving in the memory includes wirelessly transmitting the tally of the discharge material payload amount offboard the working machine to a back office system.

18. The non-transitory computer-readable storage medium according to claim 15, wherein the method further comprises:

determining, based on the tally, whether a haul truck into which a payload of the working implement is discharged is full; and outputting an alert on an operator interface of the working machine indicating that the haul truck is full.

19. The non-transitory computer-readable storage medium according to claim 15, wherein the method further comprises setting the discharge area by setting a turning angle of the working implement of the working machine and/or by setting a working radius outside of which is the discharge area and inside of which is the working area.

20. The non-transitory computer-readable storage medium according to claim 19, wherein said setting the discharge area includes moving the working implement to a first position and providing a first input to an operator interface of the working machine to set a first boundary of the discharge area followed by moving the working implement to a second position and providing a second input to the operator interface of the working machine to set a second boundary of the discharge area.

* * * * *